United States Patent [19]

Schilling et al.

[11] Patent Number: 4,879,336

[45] Date of Patent: Nov. 7, 1989

[54] NOVEL COATING SLIPS

[75] Inventors: Bernd Schilling, Burghausen; Karl-Ernst Fickert, Emmerting, both of Fed. Rep. of Germany

[73] Assignee: Wacker-Chemie GmbH, Fed. Rep. of Germany

[21] Appl. No.: 272,634

[22] Filed: Nov. 17, 1988

Related U.S. Application Data

[63] Continuation of Ser. No. 55,199, May 28, 1987, abandoned.

[30] Foreign Application Priority Data

Jul. 8, 1986 [DE] Fed. Rep. of Germany ..... 3622820

[51] Int. Cl.[4] ..... C08L 29/04

[52] U.S. Cl. ..... 524/503; 524/504

[58] Field of Search ..... 524/503, 524

[56] References Cited

FOREIGN PATENT DOCUMENTS 1163395 3/1984 Canada .
1026074 3/1958 Fed. Rep. of Germany .
2450039 4/1975 Fed. Rep. of Germany .
2933765 3/1981 Fed. Rep. of Germany .

OTHER PUBLICATIONS

Chem. Abst., vol. 87: 118700c; Kogyo K. K.; 1977, "Extrudable Vinyl Alcohol Copolymers".
Chem. Abst., vol. 91: 176392x; Kogyo K. K.; 1979, "Hot-Melt Water-Soluble Adhesives".

*Primary Examiner*—Joseph L. Schofer
*Assistant Examiner*—J. M. Reddick
*Attorney, Agent, or Firm*—Bierman & Muserlian

[57] ABSTRACT

In a coating slip for coating flat surfaces comprising an aqueous dispersion, with a solids content of 8 to 65% by weight, of 100 parts by weight of a pigment, 3 to 30 parts by weight of synthetic high-molecular-weight binder based on copolymers of acrylates, styrene, butadiene and unsaturated carboxylic acid esters and 0.5 to 2 parts by weight of a cobinder the improvement comprising using a cobinder polymer containing a large degree of hydroxyl groups comprising (a) 50 to 95% by weight of vinyl alcohol units, (b) 5 to 50% by weight of 1-alkylvinyl alcohol units of 1 to 4 alkyl carbon atoms, (c) 0 to 20% by weight of vinyl acylate units, (d) 0 to 20% by weight of allyl alcohol units and (e) 0 to 5% by weight of other polymerizable monomers having improved pigment shock behavior and very good activity as an optical brightener support.

6 Claims, No Drawings

NOVEL COATING SLIPS

PRIOR APPLICATION

This application is a continuation of copending U.S. patent application Ser. No. 055,199 filed May 28, 1987, now abandoned.

STATE OF THE ART

Coated flat substrates, particularly coating printing bases, are known which are prepared using coating slips essentially comprised of pigment, for example koalin, satin white or calcium carbonate suspended in water with the aid of a dispersing agent and binders. Whereas high-molecular-weight natural products such as starch or case in where used as binders in the past, the disadvantages of these natural binders, i.e. that they are not always produced in the same quality, they often have an obtrusive coloration, they are susceptible to infestation by microorganisms, they must be digested by expensive processes, and they produce brittle coating have led to more and more attempts today to replace them in the production of high-quality coated printed bases with synthetic high-molecular-weight binders based on copolymers of acrylates, styrene, butadiene and unsaturated carboxylic acid esters in the form of aqueous dispersions. Although the synthetic high-molecular-weight binders do not have the mentioned disadvantages of the natural polymers, they are nevertheless still in need of improvement due to the further-increasing demands on the quality of printed paper.

Improvements in this respect are achieved, for example, by adding so-called "cobinders" based on polymers of specific acrylates which cobinders control [according to Hirsch, Das Papier, Vol. 32 (10A), 1978, 66–72] particularly the viscosity and water-retention of coating colors, improve individual coating properties such as pick resistance or printing-ink absorption, and have particularly an excellent activator effect for optical brighteners.

The cobinders employed in practice are semi-synthetic, water-soluble polymers such as, for example, the sodium salt of carboxymethylcellulose and fully synthetic polymers such as, for example, copolymers of vinyl acetate and acrylamide (U.S. patent application Ser. No. 410,846 filed on October 29, 1973 by Dow Chemical Co.), and copolymers of unsaturated acid amides with vinyl or allyl alcohols (Canadian Patent No. 1,163,395). Acrylate-containing polymers which are added to the coating color as acidic, aqueous dispersions and only develop their action on alkalization, are also used as cobinders [see Hirsch, Das Papier Vol. 32 (10A1), (1978), 66–72].

However, particular importance in the cobinder field is attached to the polyvinyl alcohol class of compounds since polyvinyl alcohols not only are excellent binders for pigments, but are superior to all the above-mentioned cobinder systems, particularly with respect to their support properties for optical brighteners [see Oesterlin, DAS Papier Vol. 36, (1982), 66–72, 121–126, 170–175]. According to their degree of hydrolysis, a distinction is made between polyvinyl alcohols (PVAL) of the so-called fully-saponified types (degree of hydrolysis 98–100 mol%) and the partly-saponified types having degrees of hydrolysis of 70–90 mol%. Fully-saponified types which are used virtually exclusively as cobinders are clearly preferred in the paper-coating process according to extensive studies [Oesterlin, Das Papier, Vol. 32 (10 A), (1978), V 13–19]. The viscosities of the fully-saponified polyvinyl alcohol types employed in practice are about 4 to 10 mPas measured as 4% strength aqueous solutions (Hoppler viscosity) which corresponds to average molecular weight of about 20,000 to 50,000.

Due to their excellent pigment-binding power and support effect for optical brighteners, two serious disadvantages of these cobinders are accepted for industrial application. Fully-saponified polyvinyl alcohols are virtually insoluble in water at room temperature. For conversion into an aqueous solution, a polyvinyl alcohol suspension must be stirred vigorously for a relatively long time at at least 90° C. which ultimately encumbers the papermaking process due to the provision of dissolving stations and additional energy costs. The second disadvantage is linked with "pigment shock". When the polyvinyl alcohol solution is added to the pigment slurry, a momentary steep increase in the viscosity of the coating slips is produced. This can only be decreased rapidly with suitable stirrers which apply very high shear forces, or by adding additional auxiliaries, the so-called "anti-shock agents".

OBJECTS OF THE INVENTION

It is an object of the invention to avoid the difficulties and disadvantages described above in the preparation of coated flat structures, for example printing bases, particularly coated papers, boards and/or cardboards, without losing the advantages of the known slips.

This and other objects and advantages of the invention will become obvious from the following detailed description.

THE INVENTION

The coating slips of the invention for coating flat surfaces are comprised of an aqueous dispersion of a pigment, a dispersing agent and a binder with the improvement of a cobinder polymer containing a large degree of hydroxyl groups comprising (a) 50 to 95% by weight of vinyl alcohol units, (b) 5 to 50% by weight of 1-alkylvinyl alcohol units of 1 to 4 alkyl carbon atoms, (c) 0 to 20% by weight of vinyl acylate units, (d) 0 to 20% by weight of allyl alcohol units and (e) 0 to 5% by weight of other polymerizable monomers. Preferably, the cobinder polymer has a molecular weight of 20,000 to 100,000 determined viscosimetrically.

The preferred component (b) is 1-methyl-vinyl alcohol and compounds (c) is a vinyl acylate with 1 to 20 carbon atoms in the acylate portion.

The polymers preferably comprise 60 to 95% by weight, particularly 70 to 95% by weight of component (a), 5 to 40% by weight, preferably 5 to 20%, by weight of component (b), and 0 to 10% by weight, particularly 0 to 5%, by weight of each of components (c) and (d). According to a particularly preferred embodiment, the amount of the comonomer units (b) to (e) is in the range 5 to 20% by weight, particularly 7.5 to 10% by weight, with the amount of the vinyl acylate component particularly preferably being as low as possible, i.e. at, for example, 0 to 2% by weight. The amount of component (e) is also preferably 0 to 1% by weight, particularly in the lower half of this range, for example even below 0.2% by weight.

The said polymers used in the invention are distinguished not only by better miscibility of their solutions with the pigment slurry, with pigment shock being markedly reduced, if it occurs at all, compared to that of addition of solutions of polyvinyl alcohols which are comparable in viscosity and degree of hydrolysis. Surprisingly, the said polymers are also distinguished in that they can be stirred directly in solid form into pigment suspensions without previous dissolution or dilution. Furthermore, the polymers of the invention, besides having excellent support properties for optical brighteners, have a greater pigment-binding capacity and higher water-retention values than comparable fully-saponified polyvinyl alcohols employed in industry which extends their range of uses as cobinders.

The preferred alkyl group in component (b) is methyl but branched and unbranched alkyls of 2 to 4 carbon atoms may also be used.

The polymers are known and have been described as a protective colloid for free-radical polymerization [DE-C-1,026,074, cf. Chem. Abstr. Vol. 54, 16024 h] or as a base material for the production of molded articles [Chem. Abstr. Vol. 87, 118 700c] or in mixture with glycerol as a water-soluble hot-setting adhesive [Chem. Abstr. Vol. 91, 176392]. They can be prepared in a two-stage process. In the first stage, vinyl acylate, in particular vinyl acetate and/or vinyl propionate is copolymerized with 1-alkylvinyl acylate, in particular isopropenyl acetate and/or isopropenyl propionate, and, if appropriate, allyl acylate, in particular allyl acetate and/or allyl propionate, in a conventional fashion by free-radical suspension or emulsion polymerization in water or by free-radical polymerization without solvent or in a suitable organic solvent such as alcohols or esters. Examples of these alcohols or esters which may be mentioned are menthanol, ethanol, isopropanol, methyl acetate, ethyl acetate, isopropyl acetate and butyl acetate.

In the second stage, the copolymer thus obtained is solvolysed or hydrolyzed, preferably as completely as possible, for example by transesterification of the acylate radicals of the polymers, analogously to the processes which are known for the preparation fo polyvinyl alcohols or of (partly) saponified polyvinyl esters in alkaline or acidic media with addition of a solvolysis or of stoichiometric amounts of an appropriate coreactant, for example metal hydroxides.

The molecular weights can be adjusted in the polymerization in a conventional fashion by varying the initiator concentrations, temperature and the amount of polymerization regulators added such as bromotrichloromethane and thioacetic acid. Relatively high molecular weights can also be produced by adding small amounts of ethylenically polyunsaturated compounds such as divinyl adipate and allyl methacrylate. When used as cobinders, the polymers of the invention preferably have Hoppler viscosities of 3 to 20, in particular 4 to 12 mPas (measured as a 4% strength aqueous solution).

Another way of varying the polymers used in the invention is to incorporate (copolymerize) units which are derived from vinyl esters of increased hydrophobia, i.e., for example, vinyl fatty acid esters, for example vinyl stearate and/or vinyl laurate and/or Versatic acid vinyl esters VeoVa$^{(R)}$, esters of branched carboxylic acids having 10 to 20 carbon atoms prepared by the so-called Koch synthesis and these units increase, for example, the surface-active action of the polymers. They are preferably copolymerized in amounts of 0 to 1, in particular 0 to 0.5% by weight, relative to the total amount of the monomer units. Furthermore, ethylene, for example, can also be copolymerized in amounts of 0 to 5%, particularly 0 to 1% by weight of ethylene units.

The preparation and composition of coating slips for flat substrates, particularly for coated printing bases, including papers, boards and cardboards are known in principal. Reference need only be made for example to Canadian Patent No. 1,163,395 and U.S. patent application Ser. No 410,846 noted above. The polymers used according to the invention can be employed in conventional amounts as cobinders in known coating slips, and can at least partly, preferably completely, replace the cobinders employed therein, for example polymer B of Canadian Patent No. 1,163,395 or the copolymers of acrylamide in U.S. patent application Ser. No. 410,846 filed on Oct. 29, 1973 by Dow Chemical Co. To streamline the present application, incorporation by reference is made to the two documents mentioned above in respect of the other components of such coating slips. In the Canadian Patent No. 1,163,395 the coating slip comprises up to 2% by weight of cobinder, based on the pigments content. the coating slip of the U.S. patent application Ser. No. 410,486 comprises 100 parts by pigment, 3 to 30 parts of binder, and it has a solids content of 8 to a 65% by weight.

In the following examples and comparison experiments which are intended to served for further illustration of the invention, amounts are amounts by weight, unless otherwise stated. % indications always add up to 100% (applies to the entire publications).

In these examples and comparison experiments, the following cobinders characterized in Table 1 were employed. Their composition is produced as follows:

Copolymers made from (A) vinyl acetate, (B) isopropenyl acetate and, if appropriate, (C) allyl acetate were solvolysed according to the indication of the saponification number or the degree of solvolysis, and thereafter exhibited the viscosity specified and the K-value specified. The comparison examples are commercially available "fully saponified" polyvinyl alcohols. The properties were determined in accordance with the following measurement direction:

(1) efflux viscosity using a Hoppler falling-ball viscometer (DIN 53015) as a 4% strength aqueous solution at 20° C.; n.d.=not determined.

(2) K-value according to Fikentscher, Cellulosechemie, Vol. 13, p 58 (1932)

(3) Saponification number according to DIN 53401

EXAMPLE 1

Viscosity behavior on stirring-in the cobinders and the invention compared to the comparison products in kaolin slurries. Addition as solid.

With the aid of a high-speed stirrer, 99 parts of china clay were stirred into an aqueous solution of 0.25 parts of sodium polyacrylate and 0.1 parts of sodium hydroxide solution, and the mixture was dispersed to form a homogeneous suspension. In each case, 1 part of the cobinder was subsequently introduced in portions at a stirring speed of 1000 rpm, and the Brookfield viscosities were measured after 30 minutes. The amounts of water was selected so that the pigment suspension had a total solids content of 60%. The results are shown in Table 2 and in this table, the first value in each case shows the results at 10 rpm, and the second value in each case shows the results at 100 rpm. In this example, the customary polyvinyl alcohols virtually act only as a further filler.

TABLE 1

| Co-binder No. | A | B | C | Hoppler viscosity 4% strength | K-value[2] 1% strength | Saponi-fication no.[3] mg of KOH/g | Degree of solvol-ysis (mol %) |
|---|---|---|---|---|---|---|---|
| I | 90 | 10 | — | 5 mpas | 46 | 9 | 99.3 |
| II | 90 | 10 | — | 7 mpas | 57 | 11 | 99.1 |
| III | 90 | 10 | — | 10 mpas | 63 | 9 | 99.3 |
| IV | 85 | 15 | — | 5 mpas | 45 | 9 | 99.3 |
| V | 82.5 | 17.5 | — | 5 mpas | 41 | 9 | 99.3 |
| VI | 80 | 20 | — | 5 mpas | 40 | 12 | 99.0 |
| VII | 60 | 40 | — | n.d. | 41 | 6 | 99.5 |
| VIII | 85 | 10 | 5 | 4 | 36 | 2 | 99.8 |
| IX | 100 | | | 4 mpas | 44 | 20 | 98.4 |
| X | 100 | | | 6 mpas | 47 | 18 | 98.6 |
| XI | 100 | | | 10 mpas | 55 | 17 | 98.6 |

EXAMPLE 2

"Shock behavior" compared to a PVAL on stirring a cobinder used as in the invention into a kaolin pigment suspension.

Using a high-speed stirrer, 99 parts of china clay were stirred into an aqueous solution of 0.25 parts of sodium polyacrylate and 0.1 parts of sodium hydroxide solution and the mixture was dispersed to form a homogeneous suspension. At a stirrer speed of 100 rpm, 1 part of polyvinyl alcohol or cobinder was added as a 10% strength solution, and the power consumption of the stirrer was measured as a function of time. The amount of water was selected so that the pigment suspension had a total solids content of 60%.

| Cobinder | Power consumption before addition of the cobinder | 2 seconds after addition of the cobinder solution | 10 seconds after addition |
|---|---|---|---|
| III | 31 mW | 35 mW | 31 mW |
| XI | 31 mW | 90 mW | 31 mW |

TABLE 2

Increass in viscosity of a kaolin slurry on addition of alyky containing polyvinyl alcohols in solid form compared to fully saponified standard products.

| Cobinder | Brookfield[5] viscosity after 30 minutes |
|---|---|
| I | 2310 |
| II | 3400 |
| | 640 |
| III | 3650 |
| VIII | 1410 |
| | 354 |
| IX | 364 |
| | 157 |
| X | 402 |
| | 160 |
| XI | 416 |
| | 179 |
| Kaolin slurry without PVAL | 180 |
| | 90 |

[5]Brookfield (RVT)

EXAMPLE 3

A paper-coating color of the following composition (solids content 61%) was prepared and the water-retention capacity was measured by the Venema method[6]).

| | Parts |
|---|---|
| China Clay Dinkie A[7] | 80 |
| Omyalite 90 K[8] | 20 |
| Styrene/butadiene latex[9] | 10 |
| Blankophor[10] | 0.6 |
| Cobinder | 1.5 |

TABLE 3

Water-retention behavior when the cobinders of the invention are used compared to standard products.

| Cobinder | Water-retention capacity, secs. |
|---|---|
| I | 23.4 |
| IV | 29.4 |
| V | 32.6 |
| VI | 33.0 |
| IX | 18.8 |
| X | 20.4 |

[6]The water retention was measured using a Venema instrument comprising an electrode plate, a round electrode and an electronic measuring unit with ammeter. To determine the water retention of a coating color, a special paper was placed between the plate and the round electrode, a drop of the coating color was placed on the latter, and the time was measured until a pointer deflection (circuit completion) was indicated on the measuring instrument. The time measured is a measure of the water retention.

[7]Kaolin pigment supplied by Bassermann

[8]Chalk pigment supplied by Omya

[9]Latex supplied by Dow Chemical

[10]Optical brightener supplied by Bayer

EXAMPLE 4

Paper-coating colors of the following composition were prepared:

| | a Parts | b Parts |
|---|---|---|
| Sodium polyacrylate | 0.35 | 0.35 |
| Sodium hydroxide | 0.1 | 0.1 |
| China Clay Dinkie A | 70 | 70 |
| Omyalite 90 | 30 | 30 |
| Na CMC FF 5[11] | 0.4 | 0.4 |
| Cobinder I | 1.5 | |
| Cobinder X | | 1.5 |
| Styrene/butadiene latex | 11 | 11 |
| Blankophor(R) | 0.6 | 0.6 |
| Solids content | 61% | 61% |
| pH value | 8.5 | 8.5 |

The coating colors were applied on one side of a woody base paper weighing about 35 g/m$^2$ in an experimental coating apparatus by means of a doctor applicator at a speed of 100 n/min. the coating weight was 10.3 g/m$^2$ and the coated papers were then calendered on a 2-roll laboratory calender, and the whiteness was measured using a reflectance photometer (Zeiss) with filters R 457 (+UV) and R 400 (−UV).

| | a | b |
|---|---|---|
| Whiteness R 457 (%) | 76.38 ± 0.18 | 76.06 ± 0.18 |
| Whiteness R 400 (%) | 73.58 ± 0.17 | 73.44 ± 0.18 |
| Absolute difference | 2.8 | 2.62 |

[11]Carboxymethylcellulose supplied by Metsaliiton (Finland)

Various modifications of the coating slips of the invention may be made without departing from the spirit or scope thereof and it should be understood that the invention is to be limited only as defined in the appended claims.

What we claim:

1. In a coating slip for coating flat surfaces comprising an aqueous dispersion, with a solids content of 8 to 65% by weight, of 100 parts by weight of a pigment, 3 to 30 parts by weight of synthetic high-molecular-weight binder based on copolymers of acrylates, styrene, butadiene and unsaturated carboxylic acid esters and 0.5 to 2 parts by weight of a cobinder, the improvement comprising using a cobinder polymer containing a large degree of hydroxyl groups comprising (a) 50 to 95% by weight of vinyl alcohol units, (b) 5 to 50% by weight of 1-alkylvinyl alcohol units to 1 to 4 alkyl carbon atoms, (c) 0 to 20% by weight of vinyl acylate units, (d) 0 to 20% by weight of allyl alcohol units and (e) 0 to 5% by weight of other polymerizable monomers.

2. The coating slip of claim 1 wherein the cobinder polymer contains (a) 60 to 95% by weight of vinyl alcohol units, (b) 5 to 40% by weight of 1-alkylvinyl alcohol units and 0 to 10% by weight of components (c) and (d).

3. The coating slip of claim 2 wherein the amounts of (b) to (e) totals 5 to 20% by weight of the polymer.

4. The coating slip of claim 1 wherein the cobinder polymer has a molecular weight of 20,000 to 100,000.

5. The coating slip of claim 1 wherein the component (b) is 1-methylvinyl alcohol.

6. The coating slip of claim 1 wherein component (c) is a vinyl acylate with 1 to 20 carbon atoms in the acylate.

* * * * *